US006097154A

United States Patent [19]

Choi

[11] Patent Number: 6,097,154

[45] Date of Patent: Aug. 1, 2000

[54] MICROWAVE OVEN MAGNETRON DESIGN WITH A HARMONIC CHOKE FOLLOWING A NUMERICAL EXPRESSION

[75] Inventor: Byoung-Tae Choi, Seoul, Rep. of Korea

[73] Assignee: LG Electronics Inc., Seoul, Rep. of Korea

[21] Appl. No.: 09/086,544

[22] Filed: May 29, 1998

[30] Foreign Application Priority Data

May 31, 1997 [KR] Rep. of Korea ..... 97-22442

[51] Int. Cl.[7] ..... H01J 23/54

[52] U.S. Cl. ..... 315/39.51; 315/39.53

[58] Field of Search ..... 315/39.51, 39.53

[56] References Cited

U.S. PATENT DOCUMENTS

| | | | |
|---|---|---|---|
| 4,833,367 | 5/1989 | Harada | 315/39.51 |
| 5,180,946 | 1/1993 | Arga et al. | 315/39.51 |
| 5,894,198 | 4/1999 | Miki et al. | 315/39.51 |

FOREIGN PATENT DOCUMENTS

| | | | |
|---|---|---|---|
| 281434 | 12/1986 | Japan | 315/39.53 |

*Primary Examiner*—Justin P. Bettendorf

*Attorney, Agent, or Firm*—Finnegan, Henderson, Farabow, Garrett & Dunner, L.L.P.

[57] ABSTRACT

A method for designing a microwave oven magnetron includes design for a permissible range of a length of a choke for suppression of a harmonic higher than the fourth harmonic. The inventive magnetron includes; a cathode with a filament; a cylindrical metal anode around the cathode; a vane fixed onto the inner side of the anode for providing a plurality of resonant cavities radially directed toward the cathode; an antenna feeder having an outer diameter $\Phi_1$; upper and lower magnets fixed to upper and lower yokes; and upper and lower magnetic poles which provide paths of a magnetic circuit. An anode seal having an opening whose inner diameter $\Phi_4$ serves as a magnetic circuit path and a supporter of a body. A metal choke (having an inner diameter $\Phi_2$, an outer diameter $\Phi_3$, and a length La) is installed fixed onto the inner side of the anode seal and surrounds the antenna feeder in order to suppress over a fourth higher harmonic generated through the anode seal. The following numerical expression is used in design of $\Phi_1$–$\Phi_4$:

$$La = \frac{\lambda}{2\pi}\tan^{-1}\sqrt{\frac{\ln\frac{\phi_2}{\phi_1}}{\ln\frac{\phi_4}{\phi_3}}} = \frac{\lambda}{2\pi}\tan^{-1}\sqrt{\frac{\ln\phi_2 - \ln\phi_1}{\ln\phi_4 - \ln\phi_3}}$$

where La is from 3.0 to 4.2 mm and $\lambda$ is the wavelength of the harmonic to be suppressed.

23 Claims, 5 Drawing Sheets

MICROWAVE OVEN MAGNETRON DESIGN WITH A HARMONIC CHOKE FOLLOWING A NUMERICAL EXPRESSION

BACKGROUND OF THE INVENTION

1. Field of the Invention

The present invention relates to a method for designing a magnetron for microwave ovens, and more particularly, to a method for designing a magnetron for the microwave ovens, which is capable of improving in suppressing harmonics in over a fourth higher harmonic, especially by employing an improved choke put inside an anode seal which is an outputting block of the magnetron.

2. Discussion of Related Art

A conventional magnetron for microwave ovens, as shown in FIG. 1, is composed of a cathode 1 of a filament type set on a central position therein, a cylindrical metal anode 2 installed around the cathode 1, a vane 7 fixed onto the inner side of the anode 2, for providing a plurality of resonant cavities radially directed toward the cathode 1, an antenna feeder 8 electrically partial-connected to the vane 7, for transmitting energy of an electron group, an upper magnet 10 fixed to an upper yoke 5 and a lower magnet 10' fixed to a lower yoke 6, which forms a magnetic closed circuit for applying a magnetic field into an operational space 9 between the cathode 1 and the anode 2, an upper magnetic pole 11 and a lower magnetic pole 11' which provide paths of a magnetic circuit, an anode seal 3 serving as a supporter of the magnetic circuit path and body, an outputting ring 16 and a choke 17 for suppressing a fifth higher harmonic generated through the anode seal 3, and a discharge tube 19 for suppressing second and third higher harmonics.

The reference label 4 in FIG. 1 indicates a filament seal, reference label 12 is a cooling fin, reference label 13 is a filter box for eliminating nonessential radiation generation through an applying, reference label 14 is a high-tension condenser, reference label 15 is a choke coil for preventing components of the higher harmonic from counterflowing into the power supply and reference label 18 is an outputting cap.

Describing operations of the conventional magnetron for the microwave ovens with such a construction referring to FIGS. 1 to 3, first, the magnetic field of the permanent magnets 10 and 10' forms a magnetic circuit through the upper and lower yokes 5 and 6 and the upper and lower magnetic poles 11 and 11', to thereby form the magnetic field in the operational space between the cathode 1 and the anode 2 and apply magnetism thereinto.

By providing an electric field into the operational space 9 by the way of a supply of the power current to the cathode 1, there is radiated thermoelectron from the cathode by a mutual operation between the electric and magnetic fields.

The radiated thermoelectron is converted into high frequency energy, which is energy of an electron group, doing a cycloid movement in the operational space 9 by a plurality of the resonant cavity formed by the vane 7. The high frequency energy is transmitted to the vane 7 and output to inside a cavity of the microwave oven through the antenna feeder 8 connected to the vane 7.

At this time, 2450 MHz high frequency, for example, is generated in the resonant cavity by the anode 2 and the vane 7, and beyond this wave, at the same time the component of high harmonics having frequency corresponding to positive integer times is generated therein.

Such harmonic component is output into the cavity of the microwave oven together with the basic wave, then it is to easy in a leakage of electromagnetic wave from the microwave oven outside enough to be shorten in a wavelength of the harmonic, due to difficulty of the electromagnetic shielding.

Despite very weak leaked harmonic, such leakage harmonic is not only harmful to the human body but also causes an obstacle. To limit a radiation or a leakage of the non-necessary harmonic components, there is a filter on which a coil and a condenser are combined on its inputting side and a choke 17 made of a cylindrical metal body is combined inside the anode seal 3 of its outputting side as shown in FIG. 1.

The choke 17 is brazed on the anode seal 3 in such way that it surrounds the antenna feeder 8 inside the anode seal 3, to suppress the harmonic, height of the choke 17 including a concave part having a length of $\lambda/4$ of the harmonic wavelength to be eliminated.

The outputting ring 16 set on the outside of the anode seal 3 supports a gasket base, eliminating the harmonic.

In designing a choke for suppressing high harmonic inside such anode seal 3, a parallel resonance circuit system is used, that is, in the system the power current of specific frequency does not flow in the neighborhood of the choke by providing the choke with infinite impedance related to the restricted specific frequency, without considering a size of choke peripheral parts.

Explaining in detail the magnetron made on the basis of the parallel resonance circuit system of such harmonic suppressing choke, reference is made to FIG. 2 showing a sectional view for a harmonic suppressing choke of a magnetron. FIG. 2 is a schematic view of the higher harmonic suppressing choke 17 on which an opening part as a slot L of a loop type is directed upwards.

In FIG. 2, $\phi_1'$ provides an outer diameter of an antenna and $\phi_2'$ shows an inner diameter of an choke opening part. $\phi_3'$ indicates an outer diameter of the choke opening part and $\phi_4'$ is an appears an inner diameter of an anode seal formed as a slot L of a loop type, and La' designates a length of a choke.

FIG. 3*a* is a flow view of power current for the choke based on the parallel resonance circuit system and FIG. 3*b* depicts FIG. 3*a* as an equivalent circuit. In this equivalent circuit, an impedance Z and a specific impedance $Z_0$ may be shown as the following numerical expressions.

$$Z=iZ_0 \tan(2\pi La'/\lambda) \quad \text{[Numerical Expression 1]}$$

$$Z_0 = \sqrt{(\mu_0/\epsilon_0)/2\Pi \ln(\Phi_4'/\Phi_3')} \quad \text{[Numerical Expression 2]}$$

Meanwhile, in the parallel resonance circuit system, in considering a short-circuit face at an opening end of the slot L as the loop type forming the choke of FIG. 3*a*, its impedance Z is $\infty$, that is, in the numerical expression 1, there is the following relationship: $La'=\lambda/4'$.

Further, as understood in FIG. 3*a*, when Z is $\infty$, electric current I becomes 0, thus a transmission of the suppressed harmonic outside is shielded.

However, actually, the electric current I does not become 0 even though La' is $\lambda/4$ due to a flanging capacitor etc. among the choke and choke peripheral parts.

Accordingly, in the parallel resonance circuit system, the $\lambda/4$ length of suppressing harmonic is applied basically in a design of the choke, and respective parts of the choke are designed by selecting the index most prominent in the attenuation through an experiment in order to consider the impact of changing the value of flanging capacitor by the choke and its peripheral parts, e.g., an inner diameter of an anode seal $\phi_4'$, an outer diameter of an antenna $\phi_1'$, an inner diameter of the choke $\phi_2'$ and an outer diameter of the choke $\phi_3'$.

In a high harmonic choke of a conventional parallel resonance circuit system, however, an available permission range in the choke design is limited since a size of choke peripheral parts is not considered, furthermore its design is not precise. Thus, not only a harmonic suppression specific falls, but also an inconvenience in measuring the continuous attenuation specific and getting the optimum value is caused with much time consumption.

SUMMARY OF THE INVENTION

Accordingly, the present invention is directed to a method for designing a magnetron for microwave ovens that substantially obviates one or more of the problems due to limitations and disadvantages of the related art.

An object of the present invention is to provide a method for designing a magnetron for microwave ovens, in which suppressing high harmonic is prominent, a design for parameters of each of the chokes is very easy to obtain and a design of permissible range of a choke for suppression harmonic becomes extensive.

Additional features and advantages of the invention will be set forth in the description which follows, and in part will be apparent from the description, or may become evident by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, in a magnetron for use in microwave ovens, the magnetron including a cathode structure; an anode structure installed around the cathode structure, for forming a mutual operational space; a cavity resonator forming a plurality of cavities opening into the cathode structure in the inside of the anode structure; an antenna having an outer diameter $\phi_1$ for transmitting energy of an electron group in one cavity among a plurality of cavities; and a body providing a magnetic closed-circuit for applying magnetism into the operational space, it is constructed in such way that a supporting section is set closely fixed between the body and the antenna passes through the supporting section, the supporting section having an opening part whose inner diameter $\phi_4$ is directed towards the inside of the body; and a choke having an inner diameter $\phi_2$, an outer diameter $\phi_3$ and a length La is fixed onto the inner side of the supporting section and surrounds the antenna, in order to suppress a harmonic over a fourth higher harmonic generated through the supporting section: thereby, when a wavelength of harmonic to be suppressed is λ, the following numerical expression is obtained for the relationship between $\phi_2$ and $\phi_3$, and $\phi_1$ and $\phi_4$, e.g., $$La = \frac{\lambda}{2\Pi}\tan^{-1}\sqrt{\frac{\ln\frac{\phi_2}{\phi_1}}{\ln\frac{\phi_4}{\phi_3}}} = \frac{\lambda}{2\Pi}\tan^{-1}\sqrt{\frac{\ln\phi_2 - \ln\phi_1}{\ln\phi_4 - \ln\phi_3}}$$

wherein La is 3.0 to 4.2 mm.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

Figure 3A:
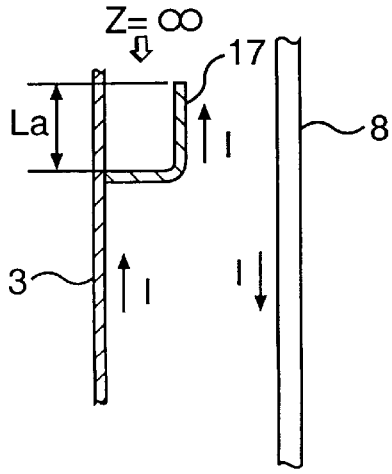
FIG. 3a PRIOR ART

FIG. 3*a* provides a flow view of electric current from an outputting block including a conventional high harmonic choke.

Figure 3B:
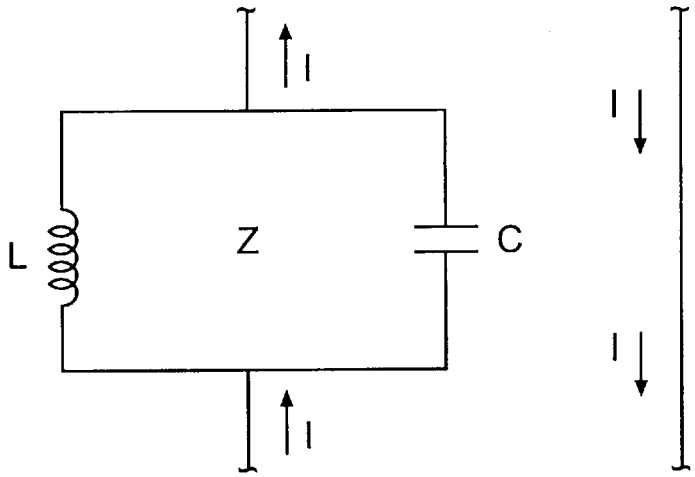
FIG. 3b PRIOR ART

FIG. 3*b* sets forth an equivalent circuit diagram of FIG. 3*a*.

Figure 4:
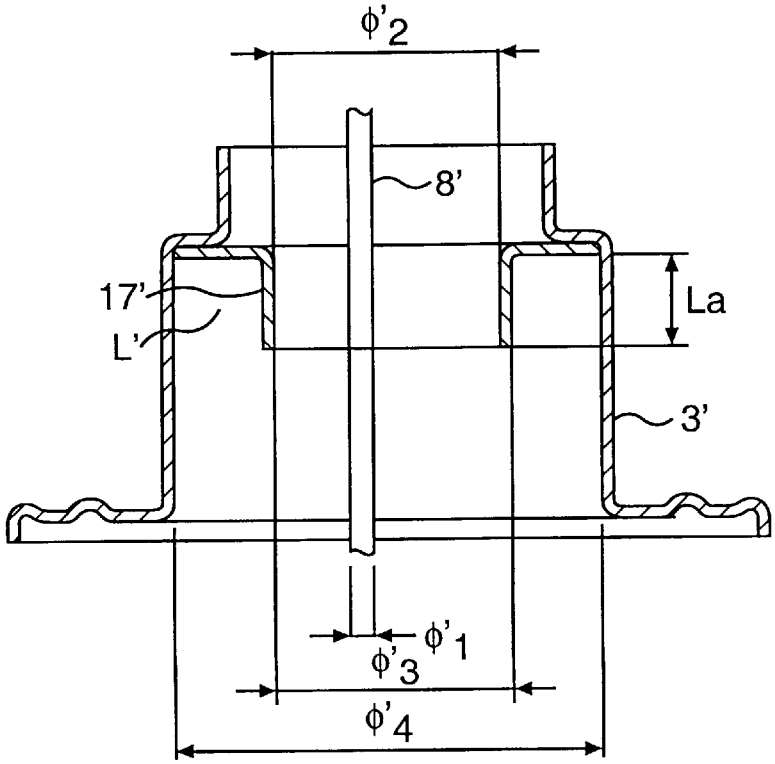

FIG. 4 illustrates a sectional view of an outputting block having a high harmonic choke in a magnetron based on a first embodiment in accordance with the present invention.

Figure 5A:
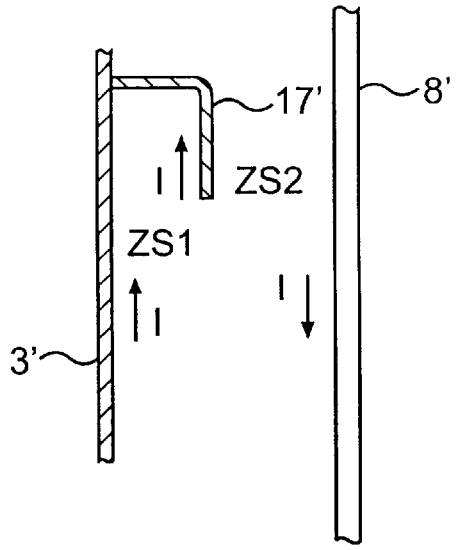

FIG. 5*a* offers a flow view of electric current in an outputting block having a high harmonic choke in the invention.

Figure 5B:
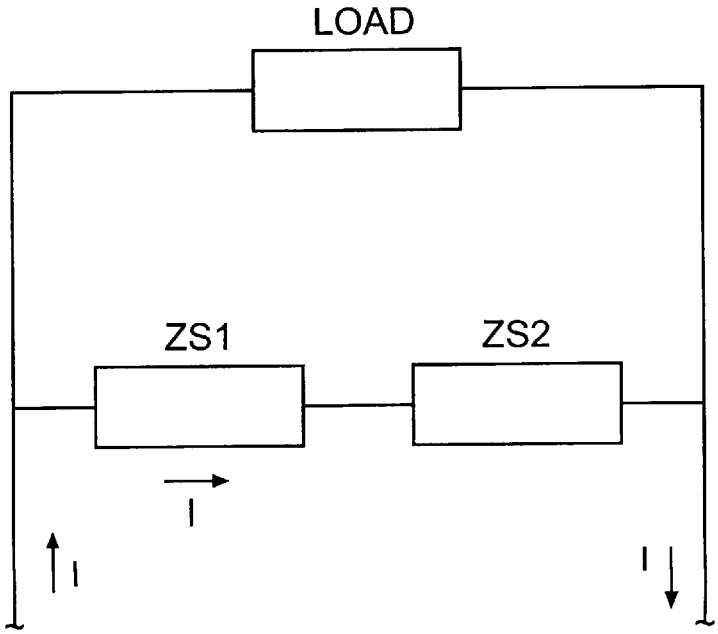

FIG. 5*b* is an equivalent circuit diagram of FIG. 5*a*.

Figure 6:
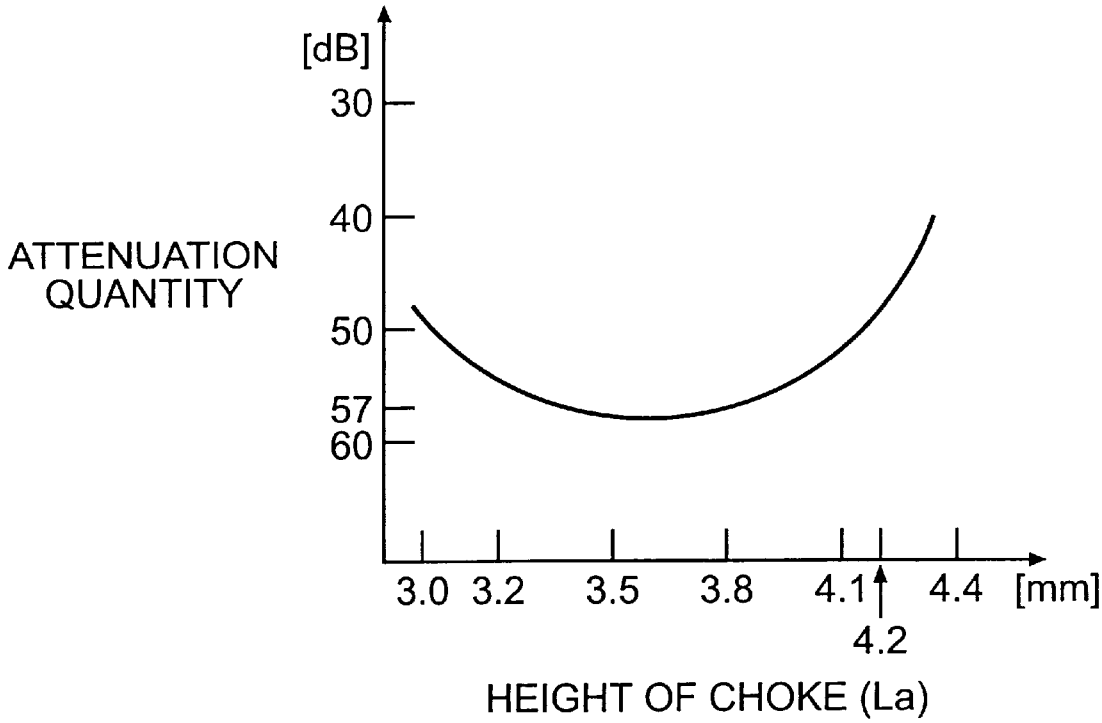

FIG. 6 indicates a graph showing an attenuation of an inventive harmonic choke in a fifth harmonic.

Figure 7:
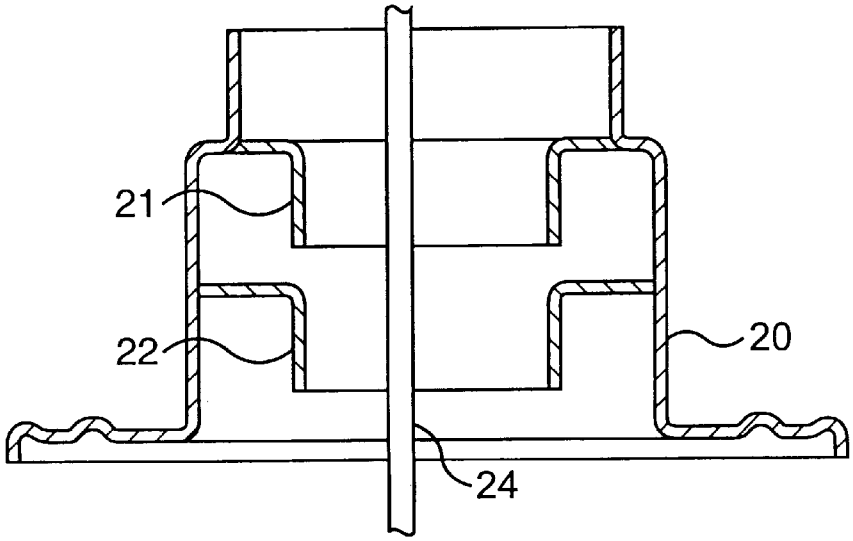

FIG. 7 provides a sectional view of an outputting block in a second embodiment in the invention.

DETAILED DESCRIPTION OF PREFERRED EMBODIMENT

Reference will now be made in detail to the preferred embodiments of the present invention, examples of which are illustrated in the accompanying drawings. The same reference labels are used in the drawings and the description to refer to the same or like parts.

FIG. 4 illustrates a schematic sectional view of a high harmonic suppressing choke designed in accordance with embodiments of the present invention. In FIG. 4, there are provided, a metal choke 17' having an inner diameter $\phi_2$, an outer diameter $\phi_3$ and a length La, in such a way that it is formed as a slot L' of a loop type by cooperating with an inner side of an anode seal 3 having a cylindrical metal type, the anode seal 3' having an opening part whose inner diameter $\phi_4$; and an antenna feeder 8' having an outer diameter $\phi_1$ and piercing through a center part of the anode seal 3'; thereby, when a wavelength of higher harmonic to be suppressed is λ, the inner and outer diameters $\phi_1$ to $\phi_4$ and the length La are designed to satisfy the following numerical expression 3.

$$\ln(\phi_4/\phi_3)\tan(2\pi La/\lambda) = \ln(\phi_2/\phi_1)\,\mathrm{Cot}(2\pi La/\lambda) \quad \text{[Numerical Expression 3]}$$

Figure 1:
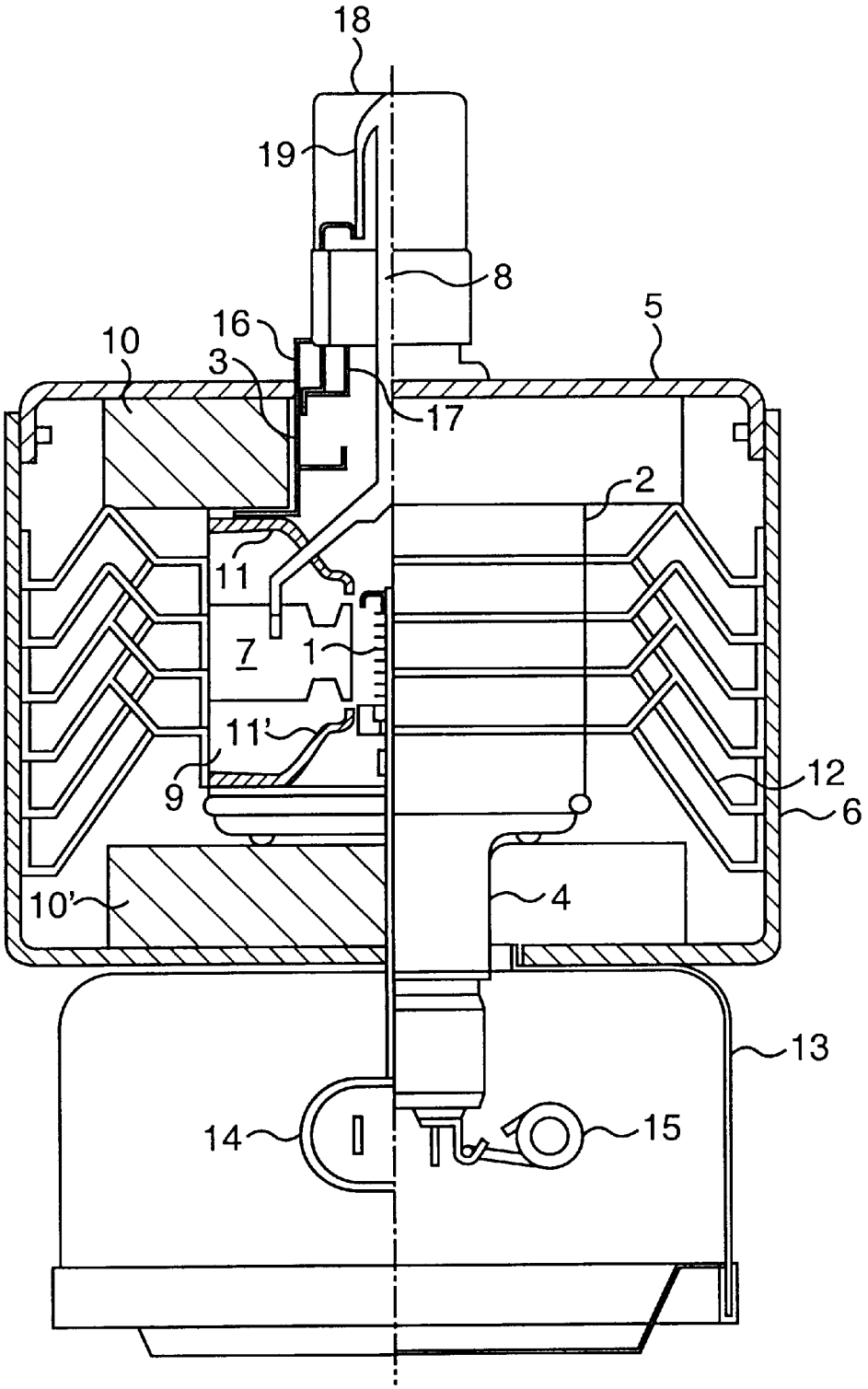
FIG. 1 PRIOR ART
FIG. 1 shows a longitudinal sectional view of a magnetron for conventional microwave ovens.

Other components in FIG. 4 are same as conventional component parts shown in FIG. 1, and the same components have the same reference numerals, omitting the detailed description.

Operations and its effect in the invention are described as follows referring to FIG. 4 to FIG. 7.

FIG. 5*a* offers a flow view showing electric current of a choke 17' appearing by a series resonance in the interior space of an anode seal 3' in the inventive magnetron. FIG.

5*b* is an equivalent circuit diagram of FIG. 5*a*. In FIG. 5*b*, $Z_{S1}$ indicates a short-circuit impedance of the choke 17' viewing at an opening end of the choke 17', as shown in FIG. 5*a*, and $Z_{S2}$ shows a space impedance between the choke 17' and an antenna feeder 8', as shown in FIG. 5*b*.

In the structure of magnetron designed as the above in accordance with the present invention, an impedance $Z_{S1}$ of the choke 17' is obtained as the following expression 4.

$$Z_{S1}=jZ_{01}\tan(2\pi La/\lambda) \quad \text{[Numerical Expression 4]}$$

herewith, $$Z_{01}=\sqrt{(\mu_0/\epsilon_0)/2\Pi\ln(\Phi_4/\Phi_3)}$$

Herein, $\in_0$ shows a dielectric constant and $\mu_0$ indicates a relative magnetic permeability.

The space impedance $Z_{S2}$ between the choke 17' and the antenna feeder 8' is gotten by the following expression 5.

$$Z_{S2}=jZ_{02}\,\mathrm{Cot}(2\pi La/\lambda) \quad \text{[Numerical Expression 5]}$$

herewith, $$Z_{02}=\sqrt{(\mu_0/\epsilon_0)2\Pi\ln(\Phi_2/\Phi_1)}$$

A synthetic impedance $Z_S$ may be obtained by the following expression 6.

$$Z_S=Z_{S1}+Z_{S2} \quad \text{[Numerical Expression 6]}$$

At this time, in order that electric current I is not transmitted to an output side, a series resonance should occur and a synthetic impedance $Z_S$ should be 0.

Accordingly, the following expression 7 can be led from the numerical expressions 4 to 6.

$$Z_S=Z_{S1}+Z_{S1}=jZ_{01}\tan(2\pi La/\lambda)+jZ_{02}\,\mathrm{Cot}(2\pi La/\lambda)=0 \quad \text{[Numerical Expression 7]}$$

Also, the following expression 8 can be gotten from the numerical expression 7.

$$1n(\phi_4/\phi_3)\tan(2\pi La/\lambda)=1n(\phi_2/\phi_1)\,\mathrm{Cot}(2\pi La/\lambda) \quad \text{[Numerical Expression 8]}$$

The numerical expression 9 is also obtained through an adjustment about La in the numerical expression 8.

$$La=\frac{\lambda}{2\Pi}\tan^{-1}\sqrt{\frac{\ln\frac{\phi_2}{\phi_1}}{\ln\frac{\phi_4}{\phi_3}}}=\frac{\lambda}{2\Pi}\tan^{-1}\sqrt{\frac{\ln\phi_2-\ln\phi_1}{\ln\phi_4-\ln\phi_3}} \quad \text{[Numerical Expression 9]}$$

wherein La is 3.0 to 4.2 mm.

Accordingly, when the respective outer diameters $\phi_1$, $\phi_2$, $\phi_3$, $\phi_4$ and the length La of the choke are designed for a wavelength $\lambda$ of suppression harmonic on the basis of the numerical expressions 8 or 9, a series space circuit represented by '$Z_S=Z_{S1}+Z_{S2}=0$' is provided. That is, the electric current of higher harmonic to be suppressed becomes 0, thereby resulting in preventing a specific harmonic from leaking outside of the structure, wherein the higher harmonic is transmitted through the anode seal 3' and the antenna feeder 8' in the vicinity of the choke 17'.

In the preferred embodiment of the present invention, for the fifth higher harmonic to be suppressed having a wavelength 24.5 mm, an outer diameter $\phi_1$ of the antenna feeder is designed as 2.5 mm, an inner diameter $\phi_2$ of the choke as 9.0 mm, an outer diameter $\phi_3$ of the choke as 10.8 mm, and an inner diameter $\phi_4$ of the opening part in the anode seal is designed as 19 mm, then the length La of the choke is obtained as 3.7 mm from the numerical expression 9.

When the length La of the choke becomes variable in a condition where each of the sizes of the outer diameter $\phi_1$ of the antenna feeder, the inner diameter $\phi_2$ and the outer diameter $\phi_3$ of the choke and the inner diameter $\phi_4$ of the opening part in the anode seal is maintained unchanged as the above, and also, when the result measured by dB for an attenuation quantity of the fifth harmonic having wavelength 24.5 mm appears, it is provided in FIG. 6.

As shown in FIG. 6, an attenuation quantity as around 57 dB is largest in about 3.7 mm of the choke length, and it notes that there is big difference between such choke length 3.7 mm and $\lambda/4$ namely 6.125 mm in the wavelength of the fifth harmonic to be suppressed by a design based the conventional parallel resonance. Particularly, as shown in FIG. 6, the proper choke length La is 3.0 to 4.2 mm since over 50 dB in the attenuation quantity can satisfy the EMI standard.

FIG. 7 illustrates a second preferred embodiment of the present invention. In contrast to the first embodiment having an installment of one choke 17' by a series resonance, in the second preferred embodiment there are set in upper and lower positions two chokes 21 and 22 inside the anode seal 20 and in the vicinity of the antennal feeder 24. The other components are same as the first embodiment thus the same reference numerals are used without detailed description.

In such second preferred embodiment, since two chokes 21 and 22 are disposed upwards and downwards inside the anode seal 20, it is constructed an two series resonance circuits in a parallel connection type in an outputting block. That is, there are a pair of the series resonance circuits, to thereby make suppressing higher harmonic more attenuated.

At this time, it is not necessary for the chokes 21 and 22 to be the same size. For example, the choke 21 is designed with parameter according to the afore-mentioned expression 9, in order to restrain the fifth harmonic, which is one of the worst, meanwhile, the choke 22 can be designed with sizes of respective parts to suppress another harmonic what is not the fifth harmonic. Further, the sizes of upper and lower chokes can be designed equally in order for suppressing only the fifth harmonic, thereby resulting in attenuating the fifth harmonic more.

Figure 2:
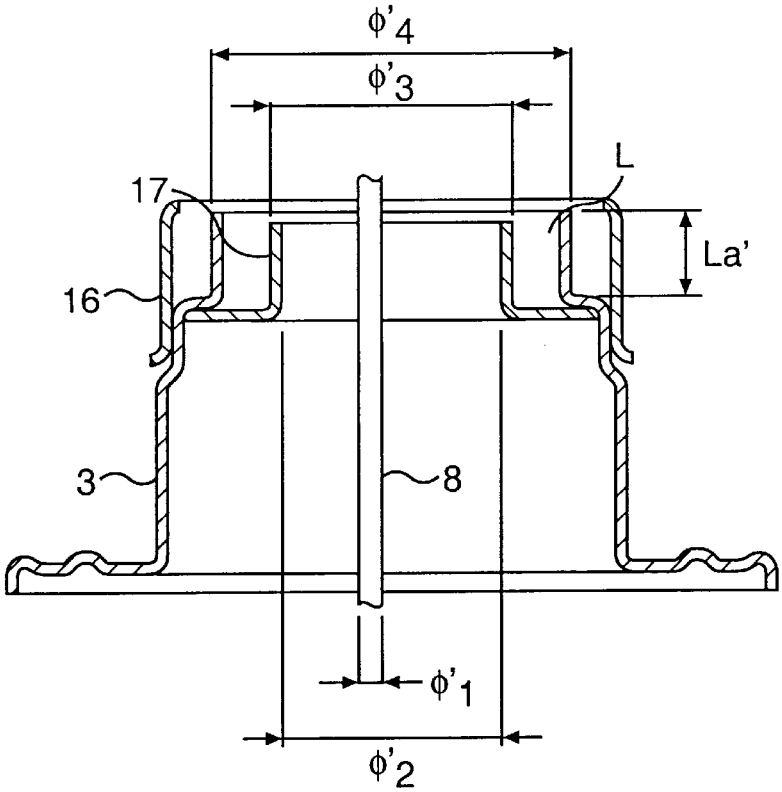
FIG. 2 PRIOR ART
FIG. 2 depicts a sectional view illustrating an outputting block of the conventional magnetron.

In the afore-mentioned embodiments of the present invention, it was described a case that the opening part of a loop formed in the harmonic suppression choke (with an L-shaped cross-section)is directed downwards, however it is not limited on this but it is apparent to apply a case for the opening part of a loop (also with an L-shaped cross-section) directed upwards to the invention, as shown in FIG. 2.

All embodiments in designing a choke with $\phi_1$ to $\phi_4$ and La, by satisfying the afore-mentioned numerical expression 8, are applicable to the present invention regardless of a direction of the opening part having a loop.

Accordingly, in the inventive magnetron, the numerical expression 8 is employed according to a wavelength of suppression harmonic to shield an electric current flow of the harmonic, thereby sizes of an anode seal, an antenna feeder and a harmonic choke as peripheral parts are designed. Also a circuit design is simplified, since there is no influence from flanging capacitor value of the choke and its peripheral parts in selecting prominent value in the attenuation.

It will be apparent to those skilled in the art that various modifications and variations can be made in the method for designing a magnetron for use of microwave ovens in accordance with the present invention without departing from the spirit or scope of the invention. Thus, it is intended that the present invention cover the modifications and variations of this invention provided they come within the scope of the appended claims and their equivalents.

What is claimed is:

1. A magnetron for use in a microwave oven, the magnetron comprising:

a generally central cathode structure;

an anode structure provided around said cathode structure for providing a mutual operation space;

a cavity resonator providing a plurality of cavities radially directed toward the cathode;

an antenna feeder having an outer diameter $\varnothing_1$, for transmitting energy in one of said cavities;

a body providing a magnetic closed-circuit for applying magnetism into the operational space;

a support section having an open portion with an inner diameter $\varnothing_4$; and at least one choke on an inside of said support section to suppress a fifth higher harmonic, the choke surrounding the antenna feeder and having an inner diameter $\varnothing_2$, an outer diameter $\varnothing_3$ and a length $L\alpha$;

wherein the relationship of $\varnothing_2$ and $\varnothing_3$ and $\varnothing_1$ and $\varnothing_4$, is given by the equation:

$$La = \frac{\lambda}{2\pi}\tan^{-1}\sqrt{\frac{\ln\frac{\varnothing_2}{\varnothing_1}}{\ln\frac{\varnothing_4}{\varnothing_3}}}$$

wherein a wavelength of harmonic to be suppressed is $\lambda$; and wherein a series resonant circuit is provided, the synthetic impedance of which is substantially zero.

2. A method of making the magnetron of claim 1, by using said equation to select $\varnothing_1$, $\varnothing_2$, $\varnothing_3$, and $\varnothing_4$.

3. The magnetron of claim 1, wherein said at least one choke includes a first choke on an upper portion of the anode and a second choke on a lower portion of the anode.

4. The magnetron of claim 3, wherein the first and second chokes have the same size and are selected to suppress a fifth higher harmonic.

5. The magnetron of claim 3, wherein the first and second chokes have different sizes, one of the first and second chokes being configured to restrain the fifth harmonic, and another of the first and second chokes being configured to suppress a different harmonic.

6. The magnetron of claim 1, wherein the length of the choke ranges from 3.0 mm to 4.2 mm.

7. The magnetron of claim 6, wherein the outer diameter $\varnothing_1$ of the antenna feeder ranges from 2.0 mm to 3.0 mm, the inner diameter $\varnothing_2$ of the choke ranges from 8.6 mm to 9.2 mm, the outer diameter $\varnothing_3$ of the choke ranges from 9.6 mm to 10.2 mm, the inner diameter $\varnothing_4$ of the open portion of the support section ranges from 19 mm to 20 mm, and the length $L\alpha$ of the choke ranges from 3.4 mm to 3.9 mm.

8. The magnetron of claim 7, wherein said at least one choke includes a first choke on an upper portion of the anode and a second choke on a lower portion of the anode.

9. The magnetron of claim 8, wherein the first and second chokes have the same size and are selected to suppress a fifth higher harmonic.

10. The magnetron of claim 8, wherein the first and second chokes have different sizes, one of the first and second chokes being configured to restrain the fifth harmonic, and another of the first and second chokes being configured to suppress a different harmonic.

11. The magnetron of claim 6, wherein said at least one choke includes a first choke on an upper portion of the anode and a second choke on a lower portion of the anode.

12. The magnetron of claim 11, wherein the first and second chokes have the same size and are selected to suppress a fifth higher harmonic.

13. The magnetron of claim 11, wherein the first and second chokes have different sizes, one of the first and second chokes being configured to restrain the fifth harmonic, and another of the first and second chokes being configured to suppress a different harmonic.

14. A method for making a magnetron for use in a microwave oven, the magnetron including a cathode, an anode around said cathode for providing a mutual operational space, the anode including an open portion with an inner diameter $\varnothing_4$, vanes on the anode for providing a plurality of resonant cavities radially directed toward the cathode, an antenna feeder having an outer diameter $\varnothing_1$ and passing through the anode, and at least one choke on an inside of the anode to suppress a fifth higher harmonic, the choke surrounding the antenna feeder and having an inner diameter $\varnothing_2$, an outer diameter $\varnothing_3$ and a length $L\alpha$, wherein the method comprises selecting $L\alpha$, $\varnothing_1$, $\varnothing_2$, $\varnothing_3$ and $\varnothing_4$ such that the relationship between $\varnothing_2$ and $\varnothing_3$ and $\varnothing_1$ and $\varnothing_4$ is provided by the equation:

$$La = \frac{\lambda}{2\pi}\tan^{-1}\sqrt{\frac{\ln\frac{\varnothing_2}{\varnothing_1}}{\ln\frac{\varnothing_4}{\varnothing_3}}}$$

wherein $\lambda$ is the wavelength to be suppressed, and wherein a series resonant circuit is provided, the synthetic impedance of which is substantially zero.

15. A magnetron made according to the method of claim 14.

16. The method according to claim 14, wherein the length $L\alpha$ of the choke ranges from 3.0 mm to 4.2 mm.

17. The method of claim 16, wherein the outer diameter $\varnothing_1$ of the antenna feeder ranges from 2.0 mm to 3.0 mm, the inner diameter $\varnothing_2$ of the choke ranges from 8.6 mm to 9.2 mm, the outer diameter $\varnothing_3$ of the choke ranges from 9.6 mm to 10.2 mm, the inner diameter $\varnothing_4$ of the open portion of the anode ranges from 19 mm to 20 mm, and the length $L\alpha$ of the choke ranges from 3.4 mm to 3.9 mm.

18. The method of claim 16, wherein said at least one choke includes a first choke on an upper portion of the anode and a second choke on a lower portion of the anode.

19. The method of claim 18, wherein the first and second chokes have the same size and are selected to suppress a fifth higher harmonic.

20. The method of claim 18, wherein the first and second chokes have different sizes, one of the first and second chokes being configured to restrain the fifth harmonic, and another of the first and second chokes being configured to suppress a different harmonic.

21. The method of claim 14, wherein said at least one choke includes a first choke on an upper portion of the anode and a second choke on a lower portion of the anode.

22. The method of claim 21, wherein the first and second chokes have the same size and are selected to suppress a fifth higher harmonic.

23. The method of claim 21, wherein the first and second chokes have different sizes, one of the first and second chokes being configured to restrain the fifth harmonic, and another of the first and second chokes being configured to suppress a different harmonic.

* * * * *

UNITED STATES PATENT AND TRADEMARK OFFICE

CERTIFICATE OF CORRECTION

PATENT NO. : 6,097,154
DATED : August 1, 2000
INVENTOR(S) : Byoung-Tae CHOI

It is certified that error appears in the above-identified patent and that said Letters Patent is hereby corrected as shown below:

In Claim 1, col. 7, line 27, "Lα" should read --L*a*--.
In Claim 2, col. 7, line 41, after "claim 1", delete the comma.
In Claim 7, col. 7, line 63, "Lα" should read --L*a*--.
In Claim 14, col. 8, line 40, "Lα" should read --L*a*--.
In Claim 14, col. 8, line 41, "Lα" should read --L*a*--.
In Claim 16, col. 8, line 58, "Lα" should read --L*a*--.
In Claim 17, col. 8, line 66, "Lα" should read --L*a*--.

Signed and Sealed this

First Day of May, 2001

*Attest:*

Nicholas P. Godici

NICHOLAS P. GODICI

*Attesting Officer*

*Acting Director of the United States Patent and Trademark Office*